US006393731B1

(12) United States Patent
Moua et al.

(10) Patent No.: US 6,393,731 B1
(45) Date of Patent: May 28, 2002

(54) IMPACT ABSORBER FOR A SHOE

(76) Inventors: Vonter Moua; Xia V. Moua, both of 1515 Avon St., La Crosse, WI (US) 54603

( * ) Notice: Subject to any disclaimer, the term of this patent is extended or adjusted under 35 U.S.C. 154(b) by 0 days.

(21) Appl. No.: 09/872,912

(22) Filed: Jun. 4, 2001

(51) Int. Cl.[7] ..... A43B 13/28

(52) U.S. Cl. ..... 36/27; 36/29; 36/35 B; 36/38

(58) Field of Search ..... 36/27, 28, 29, 36/38, 35 B, 7.8

(56) References Cited

U.S. PATENT DOCUMENTS

| | | | | | |
|---|---|---|---|---|---|
| 1,098,241 | A | * | 5/1914 | Forray | 36/38 |
| 2,104,924 | A | * | 1/1938 | Dellea | 36/38 |
| 2,444,865 | A | * | 7/1948 | Warrington | 36/36 R |
| 2,669,038 | A | * | 2/1954 | Werth | 36/38 |
| 3,777,419 | A | | 12/1973 | Nalick | |
| 4,598,484 | A | | 7/1986 | Ma | |
| 4,905,383 | A | | 3/1990 | Beckett et al. | |
| 5,005,575 | A | | 4/1991 | Geri | |
| 5,042,175 | A | | 8/1991 | Ronen et al. | |
| 5,175,946 | A | | 1/1993 | Tsai | |
| 5,438,768 | A | | 8/1995 | Bauerfeind | |
| 5,448,839 | A | | 9/1995 | Blissett et al. | |
| 5,537,764 | A | | 7/1996 | Prahl | |
| 5,566,479 | A | | 10/1996 | Gray et al. | |
| 5,651,196 | A | * | 7/1997 | Hsieh | 36/27 |
| 5,768,803 | A | | 6/1998 | Levy | |
| 5,832,629 | A | | 11/1998 | Wen | |
| 5,845,419 | A | * | 12/1998 | Begg | 36/27 |
| 5,896,680 | A | | 4/1999 | Kim et al. | |
| 5,979,086 | A | | 11/1999 | Vindriis | |
| 6,006,449 | A | * | 12/1999 | Orlowski et al. | 36/27 |
| 6,012,236 | A | | 1/2000 | Pozzobon | |
| 6,176,025 | B1 | | 1/2001 | Patterson et al. | |
| 6,178,663 | B1 | | 1/2001 | Schoesler | |
| 6,200,284 | B1 | | 3/2001 | Flick | |
| 6,216,365 | B1 | | 4/2001 | Cohen | |
| 6,282,814 | B1 | * | 9/2001 | Krafsur et al. | 36/27 |

* cited by examiner

*Primary Examiner*—Ted Kavanaugh
(74) *Attorney, Agent, or Firm*—Donald R. Schoonover

(57) ABSTRACT

An impact absorber for a shoe includes a multichamber housing having a plurality of springs located therein. Each spring can be adjusted as necessary to customize the impact absorbing characteristics of the shoe. A dividing wall is located in the multichamber housing to divide the housing into two chambers and springs can be located in each of the chambers. Cushion elements can be located in the chambers as well. A multichamber housing is located adjacent to the heel of the shoe and another multichamber housing can be located adjacent to the ball of the wearer's foot.

19 Claims, 7 Drawing Sheets

10
30
24
28
104
26
116
136
120
22
20
18
16
56
49'
14
49
48
46
54
62
114
106
119
100
130
122
134
102
132
112
108
138
12
29
42
58
44
64
60

10
30
24
28
26
16
22
20
56
49'
14
48
49
40
46
60
12
29
42
58
44
62
64

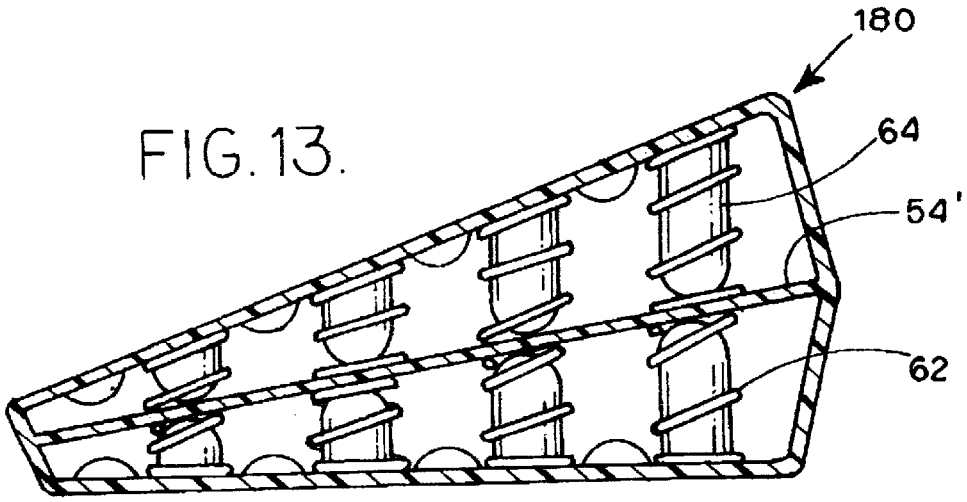
FIG. 13.
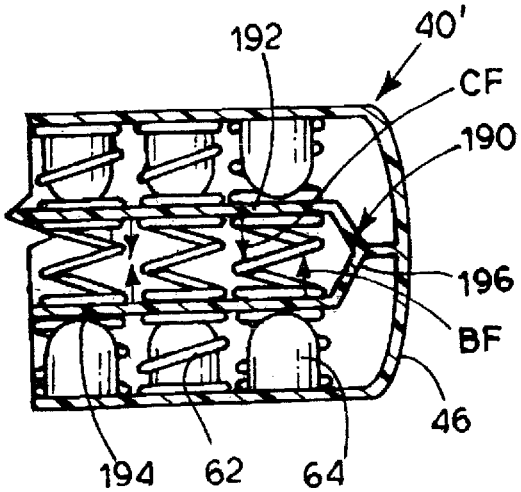
FIG. 14.
FIG. 15.
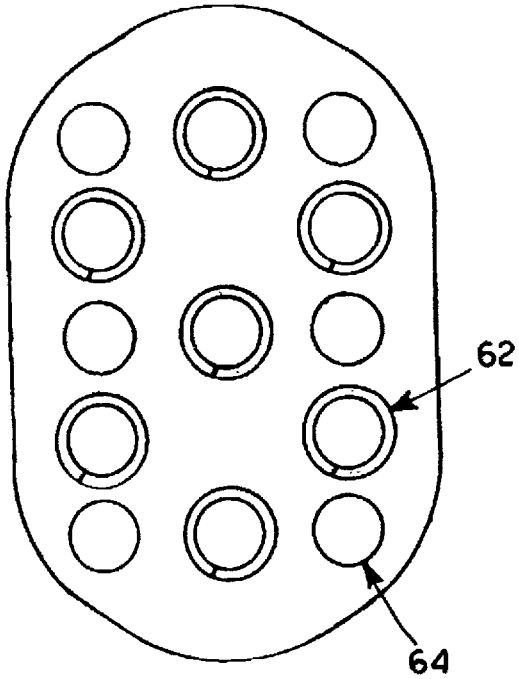

IMPACT ABSORBER FOR A SHOE

BACKGROUND OF THE INVENTION

1. Field of the Invention

The present invention relates to the general art of boots and shoes, and to the particular field of impact absorbing mechanisms associated with boots and shoes.

2. Discussion of the Related Art

Today, more and more people are engaging in activities such as walking, jogging, and running as well as sports such as basketball, tennis and the like. All of these activities expose a person's feet to repeated impacts. Over time, such impacts can have adverse effects on the person's feet, bones, joints and muscles.

Accordingly, the boot and shoe art has seen a dramatic increase in footwear designs intended to reduce the adverse effects on a wearer of such repeated impacts. These footwear designs have included various mechanisms for reducing the effects of impacts on a wearer. These designs include special insoles, fluid-filled containers or bladders integrated into the shoe and the like. Foam inserts have also been suggested.

While effective in some situations, these prior art designs have several drawbacks which vitiate the effectiveness of the designs. For example, moisture and/or heat may alter or degrade the characteristics of these mechanisms and reduce the effectiveness thereof. Still further, a liquid containing chamber or bladder may leak thereby reducing the effectiveness thereof.

Accordingly, there is a need for a shock absorber for shoes which will not degrade over time or due to exposure to moisture and/or heat.

Many people use the same shoes for various and different activities. For example, a single shoe may be used in connection with running, walking, basketball, and tennis among many other activities. While somewhat related, each of these activities exposes a person's foot to somewhat different impact characteristics. In fact, different terrain may expose a person's foot to different impact characteristics for the same activity. Thus, for example, walking over a planar surface may generate one impact profile and walking over hilly terrain may generate another impact profile. In fact, a person may simply wish to have different impact absorbing characteristics for any number of reasons.

Therefore, there is a need for a shock absorber for shoes that can be easily adjusted to generate different impact absorbing characteristic profiles.

Still further, a person's foot is an extremely complex appendage. Each portion of the same foot may react differently for the same overall impact. That is, the heel of a foot may be exposed to impact due to walking, yet each section of that same heel may react in its own particular manner to that same impact. However, prior art shoes, even those with impact absorbing capabilities, are not adjustable in a manner which will permit micro adjustments to accommodate varying impact reactions to various sections of the same foot.

Therefore, there is a need for a shock absorber for shoes that can be micro-adjusted to account for varying reactions by the same foot to an overall impact.

Still further, in addition to adjusting a shock absorbing system in a manner that accounts for variations in the person's foot, the wide range of impact absorbing accommodation will be obtained if several different forms of impact absorbing adjustments are provided. Heretofore, not only are most adjustments in shock absorbing characteristics available only on a gross level, only one form of such adjustment is generally provided.

The use of a plurality of adjusting mechanisms will permit a user to individualize his or her shoes. Thus, each person can have his or her shoes particularly adjusted to his or her individual needs and/or tastes. For example, one shock absorber setting may create a floating feeling for one wearer but be perfect for another wearer, or even for the same wearer under different conditions. Such fine and varied adjustments have not been available in the shoes embodying the prior art.

Therefore, there is a need for a shock absorber for shoes that has a plurality of adjusting mechanisms.

A heel portion of a person's foot should be protected from impacts. However, in addition to protecting the heel, the ball of the foot also needs impact protection.

Therefore, there is a need for a shock absorber for shoes that can protect both the heel of the wearer's foot and the ball of the wearer's foot from impact.

Since the ball of the foot reacts differently to impact than does the heel of the foot and is exposed to different impact profiles during the same foot motion, the mechanism protecting the ball of the foot should have different characteristics from a mechanism associated with the heel of the foot.

Therefore, there is a need for a shock absorber for shoes that can be adjusted to accommodate impacts associated with the ball of the foot.

As was discussed above in association with the heel, the ball of the foot may have sections that require special impact absorbing characteristics. Such micro-adjustment associated with both the heel of the foot and the ball of the foot is not readily available in shoes of the prior art.

Therefore, there is a need for a shock absorber for shoes that can be adjusted to accommodate impacts associated with the ball of the foot and which can be micro-adjusted for both the heel and the ball of the foot.

PRINCIPAL OBJECTS OF THE INVENTION

It is a main object of the present invention to provide a shock absorber for a shoe.

It is another object of the present invention to provide a shock absorber for shoes which will not degrade over time or due to exposure to moisture and/or heat.

It is another object of the present invention to provide a shock absorber for shoes that can be micro-adjusted to account for varying reactions by the same foot to an overall impact, shock absorber for shoes that can be easily adjusted to generate different impact absorbing characteristic profiles.

It is another object of the present invention to provide a shock absorber for shoes that has a plurality of adjusting mechanisms.

It is another object of the present invention to provide a shock absorber for shoes that can protect both the heel of the wearer's foot and the ball of the wearer's foot from impact.

It is another object of the present invention to provide a shock absorber for shoes that can be adjusted to accommodate impacts associated with the ball of the foot and which can be micro-adjusted for both the heel and the ball of the foot.

It is another object of the present invention to provide a shock absorber for shoes that can protect the ball of the wearer's foot from impact.

SUMMARY OF THE INVENTION

These, and other, objects are achieved by a shock absorber for a shoe, such as an athletic or cross-training shoe or the like, that can be adjusted in a manner that provides shock absorbing characteristics that are individualized and designed for each particular area of a wearer's foot for each particular activity. For example, a heel can have several different shock absorbing profiles each of which differs from the others. Additionally, the shock absorber of the present invention can include a section associated with the ball of the foot. The ball section can also be adjusted to provide several different impact absorbing characteristics as well.

In particular, the shock absorber of the present invention includes a multichamber housing having a first and a second chamber and a plurality of springs mounted in the second chamber of the multichamber housing. One form of the invention has one multichamber housing located adjacent to the wearer's heel and a second multichamber housing located adjacent to the ball of the wearer's foot. Each spring in the system can be individually adjusted to provide micro-adjustments for the wearer's foot. Still further the first chamber of each housing can include an adjustable air port to control air flow into and out of that chamber to further adjust the cushioning of the shock absorber. In some forms of the invention, springs are also located in the first chamber as well. A collapsible wall allows the multichamber housing to move as required during foot impacting situations.

Cushion elements are also included to further control and customize the shock absorbing characteristics of the shock absorber of the present invention.

In this manner, the present invention provides a shock absorber for shoes which will not degrade over time or due to exposure to moisture and/or heat. Furthermore, the shock absorber of the present invention can be micro-adjusted to account for varying reactions by the same foot to an overall impact, and the shock absorber can be easily adjusted to generate different impact absorbing characteristic profiles. The shock absorber of the present invention also has a plurality of adjusting mechanisms that can protect both the heel of the wearer's foot and the ball of the wearer's foot from impact. The shock absorber of the present invention can be adjusted to accommodate impacts associated with the ball of the foot and which can be micro-adjusted for both the heel and the ball of the foot and can protect the ball of the wearer's foot from impact.

BRIEF DESCRIPTION OF THE DRAWINGS

FIG. 13 is another form of the shock absorber of the present invention.

FIG. 14 is another form of the shock absorber of the present invention.

FIG. 15 is a bottom view of the shock absorber shown in FIG. 14.

DETAILED DESCRIPTION OF THE INVENTION

Other objects, features and advantages of the invention will become apparent from a consideration of the following detailed description and the accompanying drawings.

Figure 1:
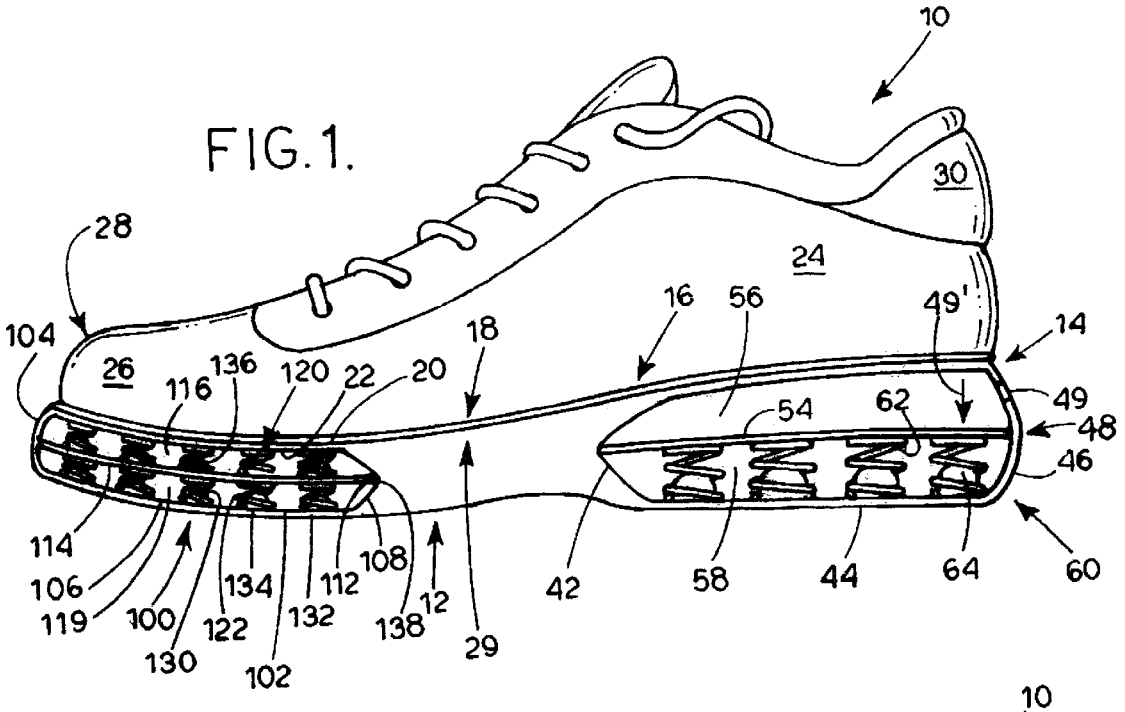
FIG. 1 is a side elevational view of one form of a shoe having a shock absorber according to the present invention.

Shown in FIG. 1 is a shoe 10 that can be used for any number of activities, including, but not limited to, running, jogging, tennis, basketball, walking, standing and the like. As discussed above, it is helpful if the wearer's shoe can absorb impacts created by such activities. Shoe 10 absorbs impacts and can be adjusted to accommodate the individual needs of each wearer and even customized so special portions of the wearer's foot can be protected differently from other portions of that same foot as required, such as for an injury or the like. This micro-adjustment is easily effected using the shock absorber system of the present invention.

As shown, shoe 10 includes a bottom section 12 having a heel section 14 and a sole section 16. Sole section 16 includes an inner sole section 18 having an insole surface 20 and an outside surface 22. Shoe 10 further includes an upper section 24 fixed to bottom section 12. Shoe 10 further includes a toe section 26 on a forward end 28 thereof, a shank section 29 between the toe section 26 of shoe 10 and heel section 14 of shoe 10, and a counter section 30 on upper section 24 of shoe 10 and located at a rearmost position on upper section 24 of shoe 10 adjacent to heel section 14 of shoe 10.

Figure 2:
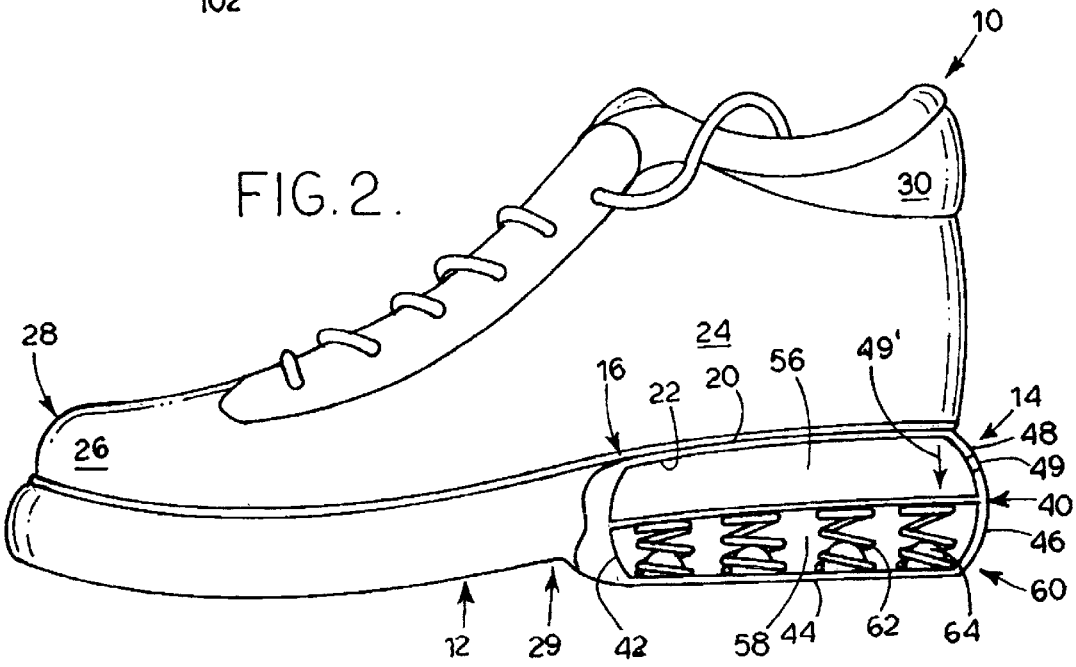
FIG. 2 is a side elevational view of another form of a shoe having a shock absorber according to the present invention.

A shoe 10' is shown in FIG. 2 and is similar to shoe 10 shown in FIG. 1 except that shoe 10 has a toe impact absorber and a heel impact absorber and shoe 10' has only a heel impact absorber. Otherwise, shoes 10 and 10' are similar. Accordingly, the same reference numerals will be used for the elements of both shoes. As shown in FIG. 2, shoe 10' includes a multichamber housing 40 on bottom section 12 of shoe 10' adjacent to heel section 14 of shoe 10'. Multichamber housing 40 includes a first wall 42 located adjacent to shank section 29 of shoe 10' and which extends from outside surface 22 of shoe 10' away from outside surface 22, an outsole wall 44 which contacts the ground or pavement when the wearer is using the shoe, and which is connected at one end thereof to first wall 42 of multichamber housing 40 and which extends toward counter section 30 of the shoe, a rear wall 46 having one end thereof connected to outsole wall 44 of multichamber housing 40 and having a second end thereof located adjacent to the outside surface 22 of shoe 10' adjacent to counter section 30 of the shoe. Rear wall 46 has a collapsible section 48 that collapses in direction 49' when a wearer places pressure on the shoe during a walking or running or standing situation. Collapsible section 48 is formed of resilient material, such as a plastics type material, that will return to the configuration shown in FIG. 2 when such compressive force is removed. As will be understood from the teaching of this disclosure, such collapsing and reforming permits the shoe to accommodate foot movements while the shock absorber operates. An air port 49 can be included in wall 46 to permit air to flow into and out of the shock absorber system of the present invention. Such air movement will permit the shock absorber system to operate and port 49 can be adjusted to control air flow therethrough whereby further control over the shock absorber system of the present invention can be exerted as will be understood from the present disclosure. As will be understood, this air flow control adds further controls to the controls discussed below. In this manner, the shock absorber of the present invention has several different modes of control.

As shown in both FIGS. 1 and 2, multichamber housing 40 further includes a dividing wall 54 connected at one end thereof to first wall 42 of multichamber housing 40 and at a second end thereof to rear wall 46 of multichamber housing 40. Dividing wall 54 is spaced apart from outside surface 22 of the shoe and from outsole wall 44 of multichamber housing 40.

As can be seen, multichamber housing 40 includes a first chamber 56 defined between first wall 42 of multichamber housing 40, outside surface 22 of said shoe, dividing wall 54 of multichamber housing 40 and rear wall 46 of multichamber housing 40. A second chamber 58 is defined between first wall 42 of multichamber housing 40, outsole wall 44 of multichamber housing 40, dividing wall 54 of multichamber housing 40 and rear wall 46 of multichamber housing 40.

Figure 11:
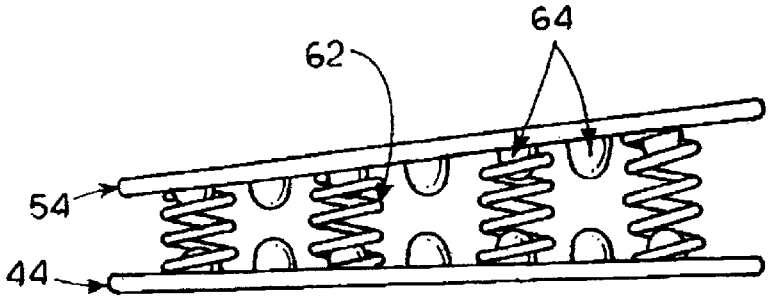
FIG. 11 is a side view of a portion of the shock absorber shown in FIG. 10.

As shown in FIGS. 1 and 2, a shock absorber system 60 is included with the shoe. Shock absorber system 60 includes a plurality of first springs, such as helical compression first spring 62, located in second chamber 58 of multichamber housing 40. Each first spring 62 is mounted on outsole wall 44 of multichamber housing 40 and is oriented to receive compressive force in direction 49' when a wearer of the shoe places pressure on the heel section of the shoe and is sized and configured to bias dividing wall 54 of multichamber housing 40 away from outsole wall 44 of multichamber housing 40 in a direction opposite to that indicated as direction 49'. As is also shown in FIGS. 1 and 2, a cushion element 64 is located inside at least one of first springs 62 and acts to further absorb impacts if the dividing wall 54 moves toward outsole wall 44 farther than the springs can normally absorb, such as when a runner is forced to suddenly stop, or trips or falls. In such a case, the chambers of the multichamber housing 40 will collapse and if the collapse is too great, the outside surface 22 of the shoe may be driven toward outsole wall 44 in direction 49' so far as to cause impact between surface 22 and dividing wall 54 and to cause injury to the wearer. While first springs 62 will absorb energy and reduce the impact, system 60 includes cushion elements 64 which further absorb such impact. Cushion elements 64 are foam or like material and can act as spring seats as well, in which case, one cushion element 64 is generally associated with each first spring 62. In some forms of the invention, cushions are located spaced from the springs (see FIG. 11) or there can be multiple cushions associated with each spring (see FIG. 4 with cushions 64' and 64" associated with a single spring).

Shock absorber system 60 also includes a spring force adjusting mechanism assembly associated with each first spring 62. As shown in FIGS. 4, 5, 6 and 7, the spring force adjusting mechanism of each shock absorber mechanism includes a screw element 70 threadably attached to outsole wall 44 of multichamber housing 40 and is also attached to the first spring 62 with which the screw element 70 is associated. The screw element 70 can be attached to the spring 62 or the spring 62 can be attached to the dividing wall 54 so that moving the screw element 70 will adjust the spring force associated with the spring element. As will be understood by one skilled in the art from the teaching of the present disclosure, tightening the screw element 70 will increase the spring force associated with a spring 62 and thus "harden" the feel of the shoe on the wearer. As will also be understood, the "feel" of the shoe at each spring location can be thus adjusted. This will permit a wearer to micro-adjust the shock absorber system 60 to accommodate not only different activities, but to accommodate particular sections of his or her foot.

As will be understood from the teaching of this disclosure, when a wearer moves his or her foot in a motion during walking, running or the like, force is applied by the heel in direction 49'. If this force is not properly absorbed, there will be impact forces applied to the wearer's foot. Over time, these impact forces may cause injury to the wearer. However, using a shoe that incorporates the shock absorber system of the present invention, such shocks will be absorbed by the springs, the cushions, and/or the air cushion in chamber 56. Each of the springs can be adjusted, or the port 49 can be adjusted to control the feel and amount of impact absorbed by system 60. In fact, the collapsible section 48 can be adjusted to further absorb impact as well, thereby adding yet another source of adjustment to system 60.

Figure 6:
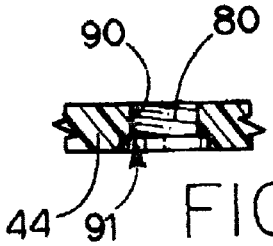
FIG. 6 shows an adjusting mechanism associated with the shock absorber of the present invention.
Figure 10:
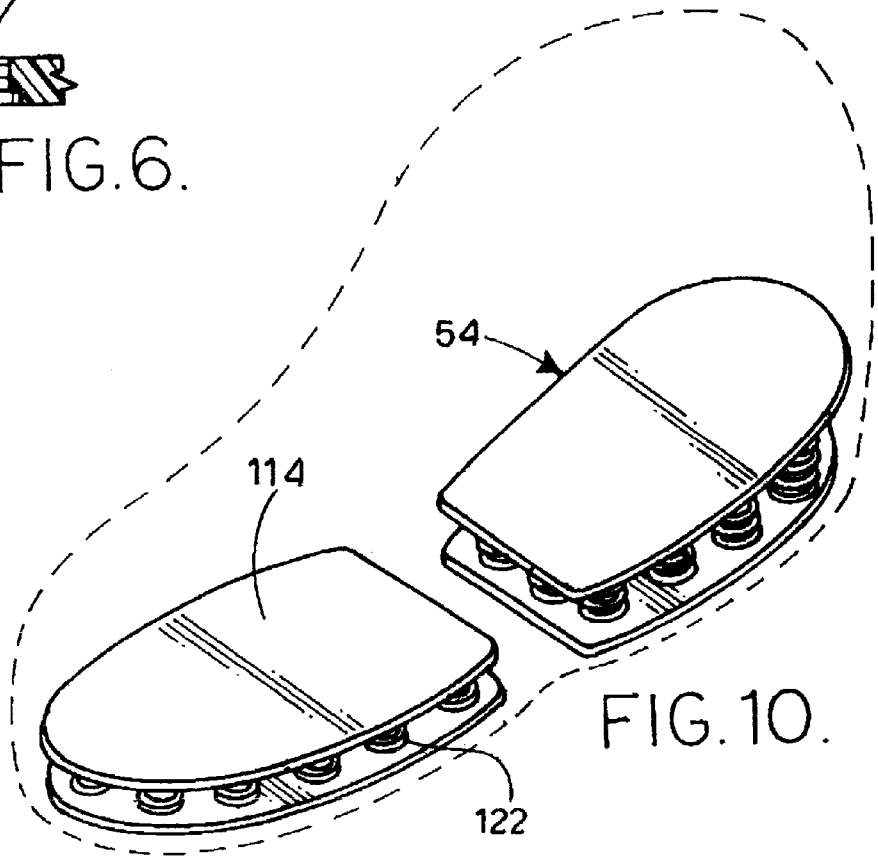
FIG. 10 is another form of the shock absorber of the present invention.
Figure 7:
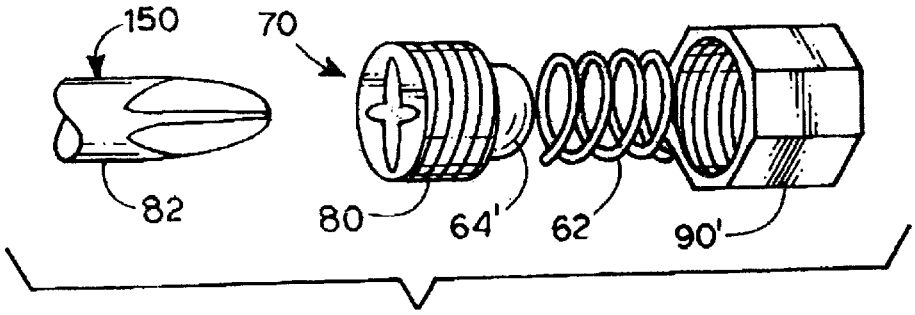
FIG. 7 shows an adjusting mechanism associated with the shock absorber of the present invention.

As indicated in FIGS. 4–7, the screw element 70 can include a bolt 80 having external threads thereon that cooperate with threads located on outsole wall 44 with bolt 80 being connected to a spring element. Bolt 80 can include Phillips slots to be engaged by a Phillips head screw driver 82 as indicated in FIG. 7 to adjust the spring force associated with the springs 62. The screw driver 82 will be discussed at greater length below.

Figure 4:
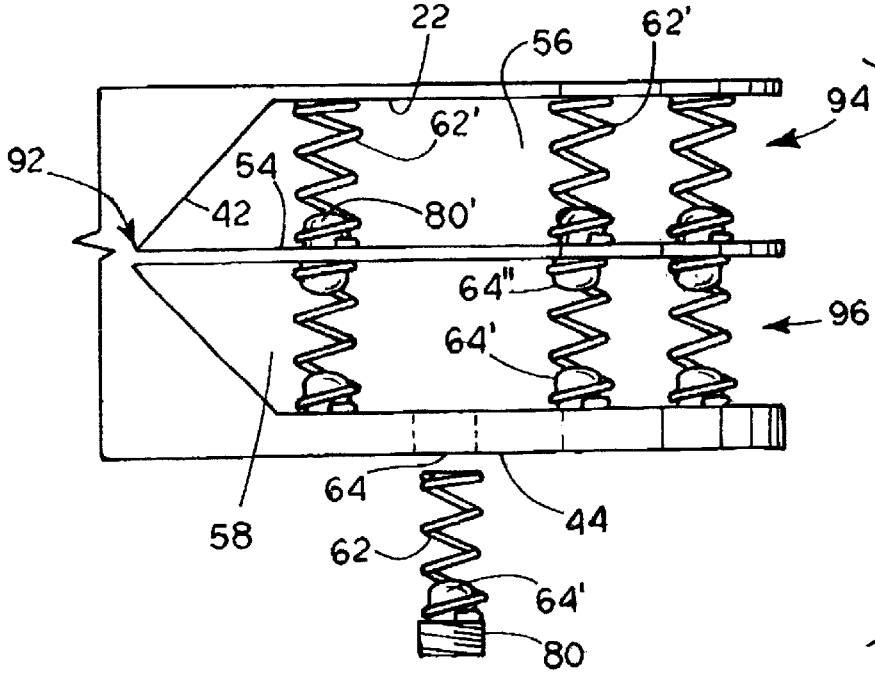
FIG. 4 is an enlarged view of another form of the heel section of a shoe having a shock absorber according to the present invention.
Figure 5:
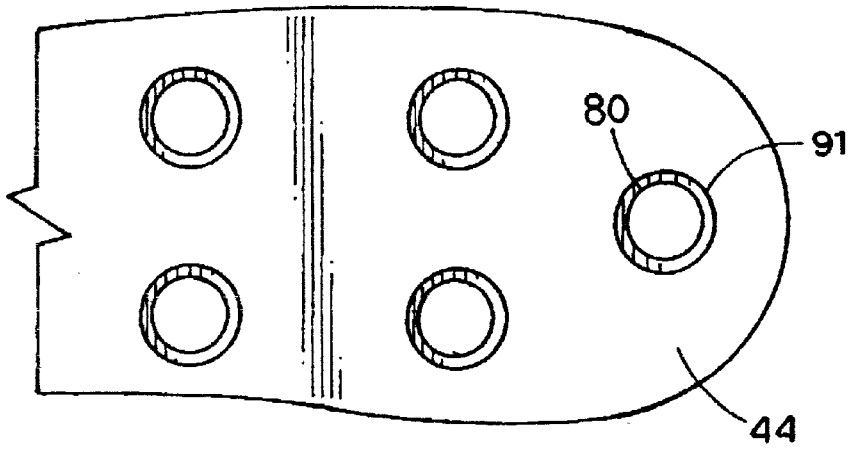
FIG. 5 is a bottom plan view of a shock absorber of the present invention.

As can be seen in FIG. 4, an alternative form of the present invention includes a plurality of second springs 62' in first chamber 56. Second springs 62' are mounted on dividing wall 54 and are also attached to outsole surface 22 and function and operate in a manner similar to that described in connection with springs 62 to absorb impact before that impact is delivered to the wearer's foot. The spring force associated with each spring 62' can be adjusted in a manner similar to that described in connection with springs 62 with the spring being attached to the screw element as well as to the housing whereby movement of the screw element compresses or releases the spring to adjust the spring force associated with the spring. Each second spring 62' can include a bolt 80' that is similar to bolt 80 and which can be accessed via an access port defined when bolt 80 is removed. Thus, a Phillips head screw driver can be inserted through opening 90 into which bolt 80 is threadably mounted via cooperating threads as above discussed. This screw driver can be engaged with a bolt 80' to adjust the spring force associated with a spring 62', and the bolt 80 replaced and the spring force associated with spring 62 adjusted. In this manner, still finer adjustments can be made to system 60. As indicated in FIG. 6, opening 90 can include a threaded sleeve, or as indicated in FIG. 7, opening 90 can be an internally threaded bolt 90' mounted on the housing. In either case, movement of bolt 80 relative to the threaded portion of either the opening or the internally threaded bolt will change the spring force of the spring associated therewith. If desired, a gap 91 can be defined between the bolt head and the adjacent surface of the housing.

Figure 3:
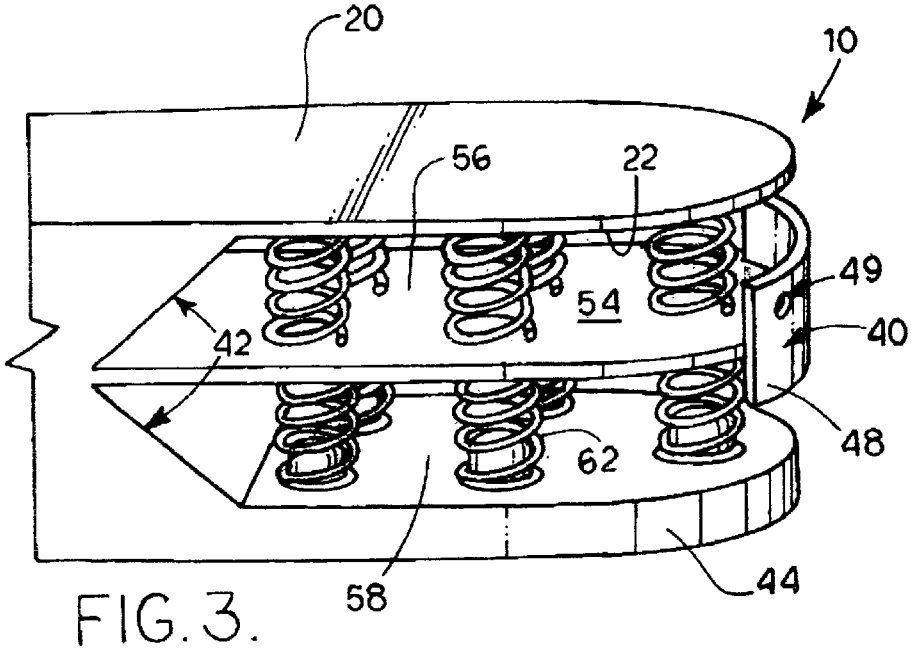
FIG. 3 is an enlarged and exploded view of a heel section of a shoe having a shock absorber according to the present invention.
Figure 12:
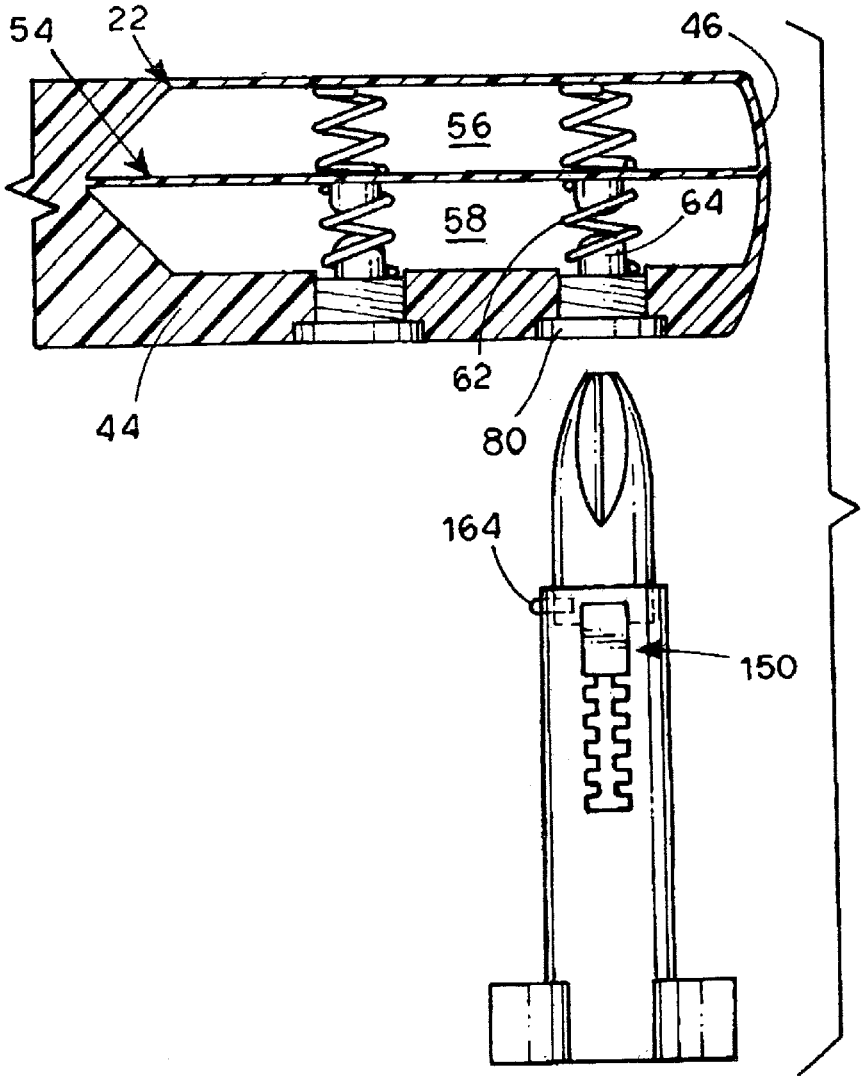
FIG. 12 shows an adjusting mechanism associated with the shock absorber of the present invention in a deployed configuration.

As can be seen in FIGS. 3 and 4, wall 42 can include an angled portion 92 and rear wall 46 can include two port areas 94 and 96. As can also be seen in FIG. 12, a bolt and a cushion can be included with each spring.

As can be seen in FIG. 1, the ball of the wearer's foot can also be protected using a shock absorber 100. Shock absorber 100 includes a second multichamber housing 102 on bottom section 14 of shoe 10 adjacent to toe section 26 of the shoe. Second multichamber housing 102 includes a first wall 104 located adjacent to toe section 26 of shoe 10 and extends from outside surface 22 of shoe 10 away from the outside surface, an outsole wall 106 connected at one end thereof to first wall 104 of second multichamber housing 102 and extends toward the heel section of shoe 10, a rear wall 108 having one end thereof connected to outsole wall 106 of second multichamber housing 102 and having a second end thereof located adjacent to outside surface 22 of shoe 10 adjacent to shank section 29 of shoe 10. Rear wall 108 of second multichamber housing 102 also includes a collapsible section 112. Multichamber housing 102 can also further include a dividing wall 114 (indicated in FIG. 1) connected at one end thereof to first wall 104 of the second multichamber housing 102 and being connected at a second end thereof to rear wall 108 of the second multichamber housing 102. Dividing wall 114 of the second multichamber housing 102 can be spaced apart from the outside surface of the shoe and from the outsole wall 106 of the second multichamber housing 102. In the form of the invention in which the second multichamber housing 102 includes dividing wall 114, this second multichamber housing 102 will include a first chamber 118 defined between first wall 104 of the second multichamber housing 102, outside surface 22 of the shoe, dividing wall 114 of the second multichamber housing 102 and rear wall 112 of the second multichamber housing 102, and a second chamber 119 defined between first wall 104 of second multichamber housing 102, outsole wall 106 of the second multichamber housing 102, dividing wall 114 of second multichamber housing 102 and rear wall 108 of the second multichamber housing 102.

A second shock absorber system 120 is located in second multichamber housing 102 and includes a plurality of first springs 122 located in second chamber 118 of second multichamber housing 102. Each first spring 122 in second multichamber housing 102 is mounted on outsole wall 106 of second multichamber housing 102 and is oriented to receive compressive force when a wearer of the shoe places pressure on toe section 26 of the shoe and to bias dividing wall 114 of the second multichamber housing 102 away from outsole wall 106 of second multichamber housing 102. System 120 further includes a cushion element 130 located inside at least one of first springs 122 in second multichamber housing 102, and a spring force adjusting mechanism assembly 132 associated with each first spring in second multichamber housing 102. Spring force adjusting mechanism 132 of each shock absorber mechanism of second multichamber housing 102 is similar to that discussed in connection with housing 40 and includes a screw element 134 threadably attached to the outsole wall of the second multichamber housing 102 and to the first spring with which the screw element is associated in the second multichamber housing 102. Cushion elements such as cushion element 136 can also be located inside each spring in the second housing 102 as well as spaced from the springs of the second housing 102 as discussed above in connection with housing 40 and an air port 138 can also be included in wall 108 to further control the shock absorbing characteristics of the second housing as discussed above in connection with housing 40.

Figure 8:
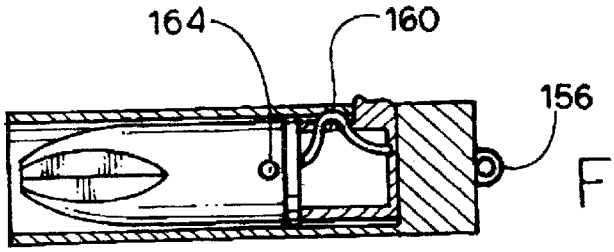
FIG. 8 shows an adjusting mechanism associated with the shock absorber of the present invention in a stowed configuration.
Figure 9:
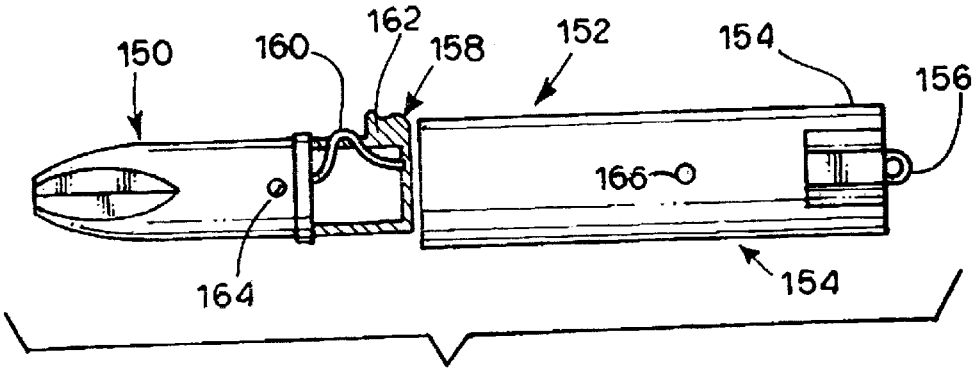
FIG. 9 shows an adjusting mechanism associated with the shock absorber of the present invention in a deployed configuration.

As discussed above, the spring force of each spring can be adjusted using a spring force adjusting means. Referring to FIGS. 8 and 9, this spring force adjusting means can include a Phillips head screw driver 150 that is part of a tool 152 which includes a handle 154 to which a tether ring 156 is attached. Screw driver 150 is adapted to assume a stored configuration shown in FIG. 8 and a deployed configuration shown in FIG. 9. A lock mechanism 158 locks the screw driver in the FIG. 9 deployed configuration and includes a lock spring 160 and a lock spring release 162. Depressing the lock spring moves the screw driver into the deployed configuration and depressing the release 162 releases the spring and permits the screw driver to be moved back into the stowed configuration. The lock includes a pop-up button 164 and a pop-up button receiving hole 166 to lock the screw driver in the desired configuration.

Figure 16:
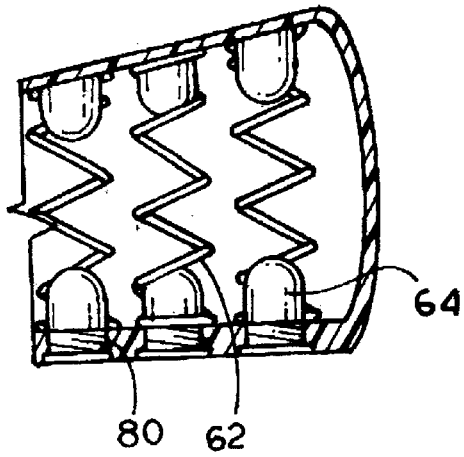
FIG. 16 is another form of the shock absorber of the present invention.

A further form of the invention includes an angled configuration as shown in FIGS. 13 and 16 for a multichamber housing that can be either the first or the second multichamber housing discussed above, but preferably is the first housing adjacent to the heel section of the shoe. In the form shown in FIGS. 13 and 16, housing 180 is identical to housing 40 except that the walls thereof are oriented at an oblique angle with respect to each other and the springs and cushions are sized to accommodate the angled nature of the first and second chambers as defined by the housing 180. As shown, the rear wall of the housing is longer than the front wall due to the angled nature of the housing. The angled housing can be used for comfort purposes when suitable.

Yet another form of the invention is shown in FIG. 14 in which dividing wall 190 includes two spaced apart walls 192 and 194 with an angled rear wall 196 connected to the two spaced apart walls and to rear wall 40' of the housing. The dividing wall shown in any of the other forms of the invention can also include plural walls similar to the wall shown in FIG. 14 if desired. As indicated in FIG. 14, compressive force CF is applied when a wearer places his or her weight on the housing, and biasing force BF is applied by the springs. Adjusting biasing force BF adjusts the "feel" of the shoe for the wearer. As each spring can be individually adjusted, each separate portion of a wearer's foot can be accommodated on an individual basis for each application of the shoe. Such micro adjustment is very beneficial. In addition to this, because there are a plurality of systems associated with absorbing impact, including air cushions, impact cushions and individually adjustable springs as well as sets of such springs included in the present shock absorber system, the overall system is very effective and can be customized as needed for the most effective impact absorbing characteristics and profiles.

Figure 17:
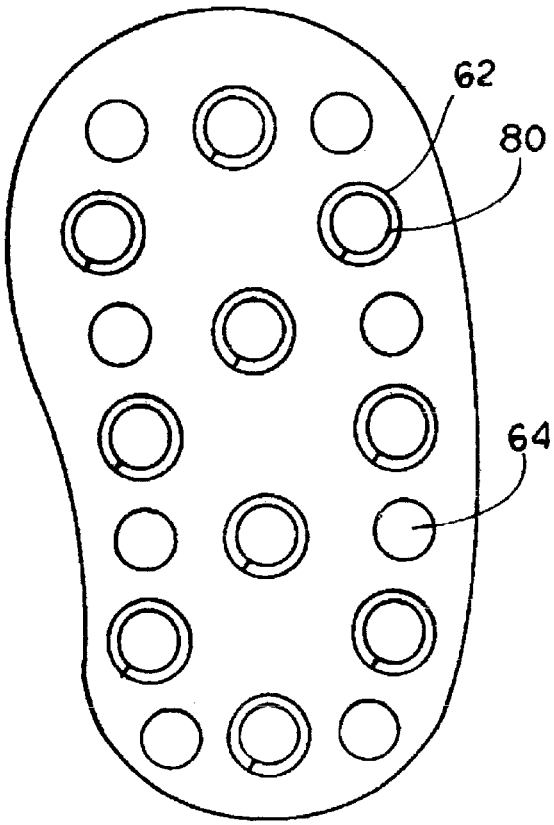
FIG. 17 is a bottom view of the shock absorber shown in FIG. 16 associated with the ball of the wearer's foot.
Figure 18:
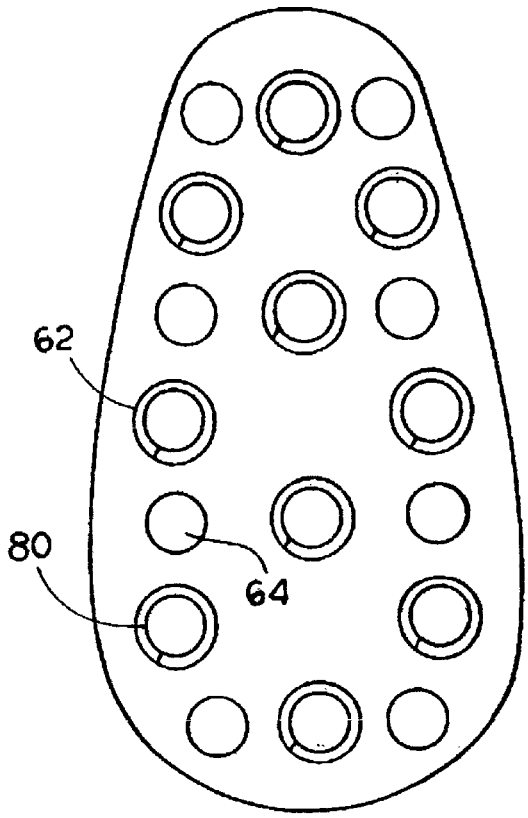
FIG. 18 is a bottom view of the shock absorber shown in FIG. 16 associated with the heel of the wearer's foot.

As indicated in FIGS. 15, 17 and 18, cushions can be associated with the springs and can also be spaced apart from the springs in all forms of the invention.

It is understood that while certain forms of the present invention have been illustrated and described herein, it is not to be limited to the specific forms or arrangements of parts described and shown.

What is claimed is:

1. A shock absorber for footwear comprising:

a) a shoe which includes (1) a bottom section having a heel section and a sole section, said sole section including an inner sole section having an insole surface and an outside surface, (2) an upper section fixed to said bottom section, (3) a toe section on a forward end of said shoe, (4) a shank section between the toe section of said shoe and the heel section of said shoe, and (5) a counter section on the upper section of said shoe and located at a rearmost position on the upper section of said shoe adjacent to the heel section of said shoe;

b) a multichamber housing on the bottom section of said shoe adjacent to the heel section of said shoe, said multichamber housing including (1) a first wall located adjacent to the shank section of said shoe and extending from the outside surface of said shoe away from the outside surface, (2) an outsole wall connected at one end thereof to the first wall of said multichamber housing and extending toward the counter section of said shoe, (3) a rear wall having one end thereof connected to the outsole wall of said multichamber housing and having a second end thereof located adjacent to the outside surface of said shoe adjacent to the counter section of said shoe, said rear wall having a collapsible section, (4) a dividing wall connected at one end thereof to the first wall of said multichamber housing and at a second end thereof connected to the rear wall of said multichamber housing, said dividing wall being spaced apart from the outside surface of said shoe and from the outsole wall of said multichamber housing, (5) a first chamber defined between the first wall of said multichamber housing, the outside surface of said shoe, the dividing wall of said multichamber housing and the rear wall of said multichamber housing, and (6) a second chamber defined between the first wall of said multichamber housing, the outsole wall of said multichamber housing, the dividing wall of said multichamber housing and the rear wall of said multichamber housing; and c) a shock absorber system which includes (1) a plurality of first springs located in the second chamber of said multichamber housing, each first spring of said plurality of first springs being mounted on the outsole wall of said multichamber housing and oriented to receive compressive force when a wearer of said shoe places pressure on the heel section of said shoe and to bias the dividing wall of said multichamber housing away from the outsole wall of said multichamber housing, (2) a cushion element located inside at least one of said first springs, and (3) a spring force adjusting mechanism assembly associated with each first spring, the spring force adjusting mechanism of each shock absorber mechanism including a screw element threadably attached to the outsole wall of said multichamber housing and to the first spring with which the screw element is associated.

2. The shock absorber defined in claim 1 wherein each first spring of said plurality of first springs has an end fixed to the outsole wall of said multichamber housing.

3. The shock absorber defined in claim 2 wherein said spring force adjusting means includes an internally threaded nut mounted on the outsole wall of said multichamber housing.

4. The shock absorber defined in claim 2 wherein the spring force adjusting mechanism of said shock absorber system further includes a spring force adjusting means which co-operates with the screw element for adjusting the spring force of the first spring associated with the spring force adjusting mechanism.

5. The shock absorber defined in claim 4 wherein the spring force adjusting means includes a screw driver.

6. The shock absorber defined in claim 5 wherein the screw driver of said spring force adjusting mechanism is a Phillips head screw driver.

7. The shock absorber defined in claim 5 wherein the screw driver includes a collapsible portion and a lock for holding the screw driver in a deployed configuration.

8. The shock absorber defined in claim 1 further including a plurality of second springs located in the first chamber of said multichamber housing.

9. The shock absorber defined in claim 8 wherein each spring of said plurality of second springs is oriented to be compressed when the wearer of the shoe places pressure on the heel of the shoe and to bias the dividing wall of said multichamber housing away from the outsole wall of the shoe.

10. The shock absorber defined in claim 9 further including a second spring force adjusting mechanism associated with each spring of said plurality of second springs, each second spring force adjusting mechanism including (1) a screw element threadably attached to the dividing wall of said housing and threadably attached to the spring of said plurality of second springs with which the screw element of said second spring force adjusting mechanism is associated, (2) a cushion element mounted on the dividing wall of said housing and spaced from the outside surface of said shoe, and (3) an access means in the outsole wall of said multichamber housing for accessing the screw elements of said second spring force adjusting mechanism.

11. The shock absorber defined in claim 1 wherein the dividing wall of said multichamber housing is oriented at an oblique angle to the outside surface of said shoe.

12. The shock absorber defined in claim 1 wherein the first wall of said multichamber housing further includes an angled section.

13. The shock absorber defined in claim 1 further including a spring mount on each spring of said plurality of first springs.

14. The shock absorber defined in claim 1 further including a port defined through the rear wall of said multichamber housing for controlling air flow into and out of said multichamber housing.

15. The shock absorber defined in claim 1 wherein the springs of said plurality of first springs are helical compression springs.

16. The shock absorber defined in claim 1 wherein the dividing wall of said multichamber housing includes two spaced apart walls.

17. The shock absorber defined in claim 1 further including a second cushion element spaced apart from at least one of the springs in said plurality of first springs.

18. A shock absorbing article of footwear comprising:

a) a shoe which includes (1) a bottom section having a heel section and a sole section, said sole section including an inner sole section having an insole surface and an outside surface, (2) an upper section fixed to said bottom section,
(3) a toe section on a forward end of said shoe,
(4) a shank section between the toe section of said shoe and the heel section of said shoe, and
(5) a counter section on the upper section of said shoe and located at a rearmost position on the upper section of said shoe adjacent to the heel section of said shoe;

b) a first multichamber housing on the bottom section of said shoe adjacent to the heel section of said shoe, said multichamber housing including
(1) a first wall located adjacent to the shank section of said shoe and extending from the outside surface of said shoe away from the outside surface,
(2) an outsole wall connected at one end thereof to the first wall of said first multichamber housing and extending toward the counter section of said shoe,
(3) a rear wall having one end thereof connected to the outsole wall of said first multichamber housing and having a second end thereof located adjacent to the outside surface of said shoe adjacent to the counter section of said shoe, said rear wall having a collapsible section,
(4) a dividing wall connected at one end thereof to the first wall of said first multichamber housing and at a second end thereof connected to the rear wall of said first multichamber housing, said dividing wall being spaced apart from the outside surface of said shoe and from the outsole wall of said first multichamber housing,
(5) a first chamber defined between the first wall of said first multichamber housing, the outside surface of said shoe, the dividing wall of said first multichamber housing and the rear wall of said first multichamber housing, and
(6) a second chamber defined between the first wall of said first multichamber housing, the outsole wall of said first multichamber housing, the dividing wall of said first multichamber housing and the rear wall of said first multichamber housing;

c) a first shock absorber system which includes
(1) a plurality of first springs located in the second chamber of said first multichamber housing, each first spring of said plurality of first springs being mounted on the outsole wall of said first multichamber housing and oriented to receive compressive force when a wearer of said shoe places pressure on the heel section of said shoe and to bias the dividing wall of said first multichamber housing away from the outsole wall of said first multichamber housing,
(2) a cushion element located inside at least one of said first springs in said first multichamber housing, and
(3) a spring force adjusting mechanism assembly associated with each first spring in said first multichamber housing, the spring force adjusting mechanism of each shock absorber mechanism including a screw element threadably attached to the outsole wall of said first multichamber housing and to the first spring with which the screw element is associated in said first multichamber housing;

d) a second multichamber housing on the bottom section of said shoe adjacent to the toe section of said shoe, said second multichamber housing including
(1) a first wall located adjacent to the toe section of said shoe and extending from the outside surface of said shoe away from the outside surface,
(2) an outsole wall connected at one end thereof to the first wall of said second multichamber housing and extending toward the heel section of said shoe,
(3) a rear wall having one end thereof connected to the outsole wall of said second multichamber housing and having a second end thereof located adjacent to the outside surface of said shoe adjacent to the shank section of said shoe, the rear wall of said second multichamber housing having a collapsible section,
(4) a dividing wall connected at one end thereof to the first wall of said second multichamber housing and connected at a second end thereof to the rear wall of said second multichamber housing, the dividing wall of said second multichamber housing being spaced apart from the outside surface of said shoe and from the outsole wall of said second multichamber housing,
(5) a first chamber defined between the first wall of said second multichamber housing, the outside surface of said shoe, the dividing wall of said second multichamber housing and the rear wall of said second multichamber housing, and
(6) a second chamber defined between the first wall of said second multichamber housing, the outsole wall of said second multichamber housing, the dividing wall of said second multichamber housing and the rear wall of said second multichamber housing; and e) a second shock absorber system which includes
(1) a plurality of first springs located in the second chamber of said second multichamber housing, each first spring of said plurality of first springs in said second multichamber housing being mounted on the outsole wall of said second multichamber housing and oriented to receive compressive force when a wearer of said shoe places pressure on the toe section of said shoe and to bias the dividing wall of said second multichamber housing away from the outsole wall of said second multichamber housing,
(2) a cushion element located inside at least one of said first springs in said second multichamber housing, and
(3) a spring force adjusting mechanism assembly associated with each first spring in said second multichamber housing, the spring force adjusting mechanism of each shock absorber mechanism of said second multichamber housing including a screw element threadably attached to the outsole wall of said second multichamber housing and to the first spring with which the screw element is associated in said second multichamber housing.

19. The shock absorber defined in claim 18 further including a plurality of second springs located in the first chamber of said second multichamber housing.

* * * * *